US011465814B2

(12) United States Patent
Buckley

(10) Patent No.: US 11,465,814 B2
(45) Date of Patent: Oct. 11, 2022

(54) TUBE SQUEEZING DEVICE

(71) Applicant: Wayne Buckley, Venice, FL (US)

(72) Inventor: Wayne Buckley, Venice, FL (US)

( * ) Notice: Subject to any disclaimer, the term of this patent is extended or adjusted under 35 U.S.C. 154(b) by 0 days.

(21) Appl. No.: 17/544,001

(22) Filed: Dec. 7, 2021

(65) Prior Publication Data

US 2022/0234787 A1 Jul. 28, 2022

Related U.S. Application Data

(60) Provisional application No. 63/142,950, filed on Jan. 28, 2021.

(51) Int. Cl.
*B65D 35/32* (2006.01)

(52) U.S. Cl.
CPC ..... *B65D 35/32* (2013.01)

(58) Field of Classification Search
CPC . B65D 35/28–285; B65D 35/32; B65D 35/34
See application file for complete search history.

(56) References Cited

U.S. PATENT DOCUMENTS 1,797,727 A * 3/1931 La Spisa ..... B65D 35/34 222/97
2,500,274 A * 3/1950 Brown ..... B65D 35/34 222/100
2,583,511 A * 1/1952 Jung ..... B65D 35/32 188/18 A
2,717,103 A * 9/1955 Hill ..... B65D 35/34 222/100
3,204,824 A * 9/1965 McGraw, Jr. ..... B65D 35/34 222/100
3,581,943 A * 6/1971 Koenigshof ..... B05C 17/005 222/102
3,759,421 A * 9/1973 Hausmann ..... B65D 35/32 222/99
4,352,441 A * 10/1982 Rosenlind ..... B65D 35/32 222/99
5,178,301 A * 1/1993 McGanty ..... B65D 35/32 222/99

(Continued)

FOREIGN PATENT DOCUMENTS

FR 1339112 A * 10/1963 ..... B65D 35/32

*Primary Examiner* — Frederick C Nicolas
*Assistant Examiner* — Randall A Gruby
(74) *Attorney, Agent, or Firm* — Brennan, Manna & Diamond, LLC

(57) ABSTRACT

The present invention relates to a tube squeezing device for effectively evacuating all the material, paste, or product inside collapsible and flexible tubes. The tube squeezing device comprises a handle and clip end formed from an upper arm and a lower arm for securing the tube body. The clip end includes the upper arm and the lower arm with a slot therebetween. The tube is received in between the slot in order to urge dispensing of the material from the tube by rotating the handle to roll the arms along the tube body to push the material within the tube towards its dispensing end for easy evacuation without any wastage of product and money. The tube squeezing device is adjustable in size to accommodate tubes of different sizes and can be used by children, adults, elderly and others with compromised dexterity and strength.

18 Claims, 4 Drawing Sheets

(56) References Cited

U.S. PATENT DOCUMENTS

| | | | | |
|---|---|---|---|---|
| 5,277,335 | A * | 1/1994 | Okami | B65D 35/28 222/102 |
| 5,372,282 | A * | 12/1994 | Barchus | B65D 35/285 222/102 |
| 5,884,812 | A * | 3/1999 | Stawowski | B65D 35/32 222/100 |
| 6,247,618 | B1 * | 6/2001 | Liberatore | B65D 35/32 222/100 |
| 9,365,328 | B1 * | 6/2016 | Johnson | B65D 35/34 |
| 11,096,529 | B1 * | 8/2021 | Cotner | B65D 83/0055 |
| 2002/0011497 | A1 * | 1/2002 | Farris | B65D 35/285 222/105 |
| 2002/0113085 | A1 * | 8/2002 | Wheatley | B65D 35/34 222/100 |
| 2006/0043107 | A1 * | 3/2006 | Rodrigues | B65D 35/32 222/99 |
| 2007/0075092 | A1 * | 4/2007 | Allen | B65D 35/565 222/103 |
| 2009/0302054 | A1 * | 12/2009 | Cragnolini | B65D 35/34 222/100 |
| 2009/0321477 | A1 * | 12/2009 | Baca | B65D 35/34 222/93 |
| 2011/0006077 | A1 * | 1/2011 | Peterson | B65D 35/34 222/521 |
| 2019/0119006 | A1 * | 4/2019 | Winikoff | B65D 35/28 |
| 2021/0292050 | A1 * | 9/2021 | Tassias | B65D 35/40 |
| 2021/0331837 | A1 * | 10/2021 | Oberkrom | B65D 35/44 |

* cited by examiner

TUBE SQUEEZING DEVICE

CROSS-REFERENCE TO RELATED APPLICATION

The present application claims priority to, and the benefit of, U.S. Provisional Application No. 63/142,950, which was filed on Jan. 28, 2021 and is incorporated herein by reference in its entirety.

FIELD OF THE INVENTION

The present invention relates generally to the field of squeezing devices. More specifically, the present invention relates to a tube-squeezing device used to squeeze out the remainder of a product or material from a flexible or collapsible tube. The tube-squeezing device features a clip end having a slot to firmly secure the tube body at a closed end, and a handle to rotate the device over the secured tube body to squeeze and wind the tube body in order to push the material inside the tube toward an open end for evacuation of all the material from the tube. The invention ensures all product/material is evacuated from the tube, and that there is no waste of product. Accordingly, the present disclosure makes specific reference thereto. Nonetheless, it is to be appreciated that aspects of the present invention are also equally applicable to other like applications, devices, and methods of manufacture.

BACKGROUND OF THE INVENTION

By way of background, paste, moisturizing creams, shaving creams, ointments, paints and other products are often sold in flexible tubes. Tubes, also referred to as squeeze tubes or collapsible tubes, are a flexible and collapsible package having a generally cylindrically-shaped body with a round open orifice on one end, that can be closed using caps and closures, and featuring a sealed or closed opposing end. Squeezable pastes and creams, such as paste, gels, facial creams, and more, are filled inside such tubes for packaging and containing the product.

Generally, the material such as paste, gels, creams, ointments, or more, are dispensed from these tubes by removing the cap on one end of the tube and squeezing the walls of the tube proximal to another end. While the tube is new and filled with the product or material, individuals can easily squeeze out the product/material from the tube. However, removing all liquid or paste-like contents from a tube can be difficult. Often, material or product is left in the tube because individuals are unable to squeeze out the last remaining volume of product. Product left in the tube is essentially wasted and ultimately leads to loss of money.

Also, children and the elderly find it extremely difficult to dispense the product from the tube when there is very little amount of product/material left inside the tube. Children and the elderly may throw the tube away with significant unused material inside. This leads to wastage of product and money as well. To overcome such issues, some individuals may use excessive manual pressure throughout the tube body using both hands to evacuate the remaining product in the tube. Some may also try to tamper with, or cut open, the tube body to extract all of the product from the tube. However, this requires a lot of manual effort, and is inconvenient to the users.

Therefore, there exists a long felt need in the art for a device that assists users in squeezing all of the material out of the collapsible tubes. There is also a long felt need in the art for a tube squeezing device that allows the users to conveniently evacuate all the material out of the tube body. Additionally, there is a long felt need in the art for a tube-squeezing device which prevents unwanted wastage of material or product inside the tube and therefore saves money as well. Moreover, there is a long felt need in the art for a tube-squeezing device that can be easily used by children, adults, elderly and others for evacuating all the product from the tube. Further, there is a long felt need in the art for a product-dispensing solution that does not require the users to expend a great deal of effort in dispensing material out of the collapsible tubes. Furthermore, there is a long felt need in the art for a tube squeezer which eliminates the need to tamper with, or cut open, the collapsible tube body to completely extract the material out of the tube. Finally, there is a long felt need in the art for a tube squeezing device that ensures all product or material is evacuated from the tube and prevents any wastage of product and money.

The subject matter disclosed and claimed herein, in one embodiment thereof, comprises a tube-squeezing device. The tube-squeezing device is configured to remove product or material from the tube effectively and without any wastage. The tube-squeezing device further comprises a handle, an upper arm and a lower arm. The upper arm and the lower arm are attached to an interior surface of the handle and extend orthogonal from the handle. A slot is formed between the upper arm and the lower arm along the length of the arms and is configured and dimensioned to receive the tube therebetween for rolling and squeezing of the tube. The arms are telescoping and can be extended or retracted to fit tubes of various widths. The tube-squeezing device is rotated to roll the arms along the tube body in order to squeeze, roll, and coil the tube body, thereby pushing and advancing the material within the tube towards the dispensing end for easy evacuation with minimal to no wastage.

In this manner, the novel tube squeezer of the present invention accomplishes all of the forgoing objectives, and provides a relatively convenient and effective solution to evacuate all product or material from tube containers. The tube squeezer of the present invention is also user-friendly, as it does not require the users to expend a great deal of effort in dispensing the little amount of product remaining inside the tube body, prevents any unwanted wastage of the product in the tube and saves money as well. Additionally, the tube squeezer can be easily used by children, adults, the elderly and others. Further, the tube squeezer device is adjustable and can be universally used to accommodate different kinds and widths of collapsible tubes to extract any respective pastes, gels, creams, or other material inside the tube body.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a tube-squeezing device. The tube-squeezing device is configured to remove product or material from the tube effectively and without any wastage. The tube squeezing device further comprises a handle, an upper arm and a lower arm. The upper arm and the lower arm are attached to an interior surface of the handle and extend orthogonal from the handle. A slot is formed between the upper arm and the lower arm along the length of the arms and is configured and dimensioned to receive the tube therebetween for rolling and squeezing of the tube. The arms are telescoping and can be extended or retracted to fit tubes of various widths. The tube-squeezing device is rotated to roll the arms along the tube body in order to squeeze, wind, and coil the tube body, thereby pushing and advancing the material within the tube towards the dispensing end for easy evacuation with minimal to no wastage.

In a further embodiment of the present invention, a paste tube squeezer is disclosed. The paste tube squeezer includes an upper arm and a lower arm extending from a handle for holding a paste tube therebetween. The upper arm and the lower arm are telescoping and can be extended or retracted. The arms can include edges for a firm grip on the paste tube held therebetween. The handle can be configured to rotate the arms along the tube body to move the material within the tube to a dispensing end of the tube and the other end of the tube is rolled and wound onto and around the arms for a smooth movement and effective advancement of the material toward the dispensing end of the tube.

In a further embodiment of the present invention, a device for squeezing one or more of a paste tube, a medicine tube, a paint tube, a cosmetic tube, an adhesive tube or a ketch-up tube is disclosed. The device includes a handle or holder and a pair of telescoping arms extending longitudinally and orthogonally from the center of the handle. The pair of arms are designed to create a slot therebetween along the length of the arms for holding and anchoring a terminal end portion of the tube. The device can then be rotated and wound towards a dispensing end of the tube by grasping the handle and allowing the arms to roll, coil, wind or wrap the length of the tube in order to squeeze and advance the product within the tube toward the dispensing end for easy removal of the product without any wastage.

In yet a further embodiment of the present invention, the squeezing device can include a small or large handle to firmly grasp the device for convenient turning of the device in order to coil, wind, or wrap the length of the tube. The telescoping mechanism of the arms allows users to adjust the length of the arms to accommodate different tube width sizes. The device provides a mechanism to evacuate the entire contents inside a flexible or collapsible tube, offering a way for anyone, even those with limited physical dexterity, to easily remove product from a tube. The collapsible tube used with the device of the present invention can be, for example, a paste tube, a hand lotion tube, a hair coloring tube, some other tube containing cosmetic paste, or, for example, a tube containing a food substance, such as mayonnaise.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
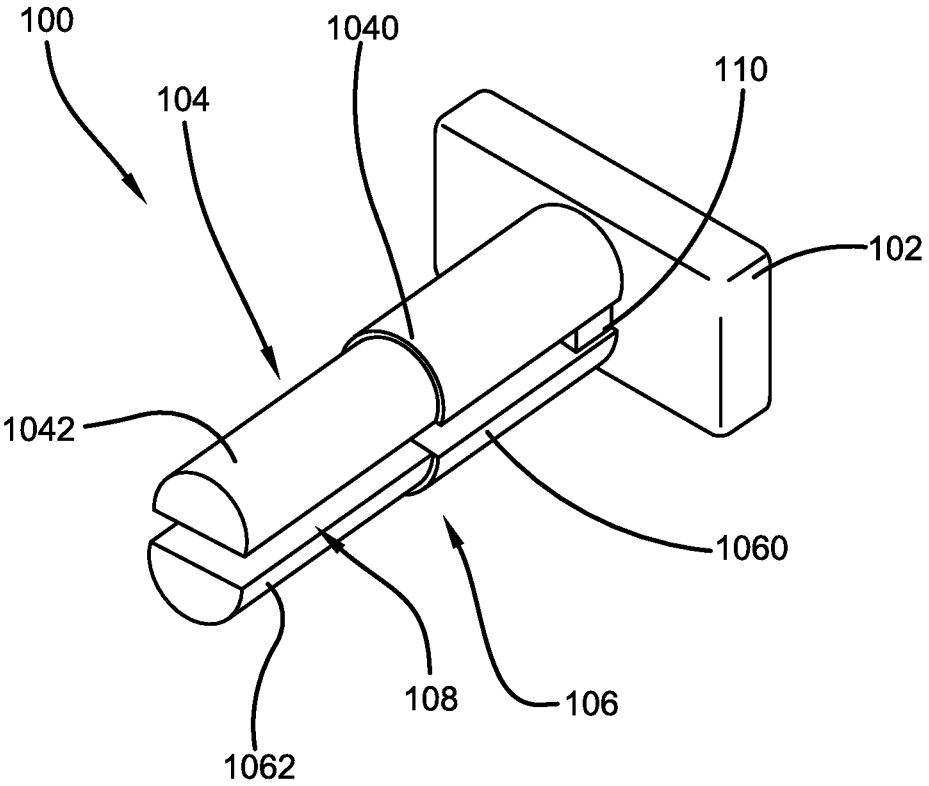
FIG. 1 illustrates a perspective view of one potential embodiment of a tube-squeezing device of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there exists a long felt need in the art for a device that assists users in squeezing all of the material out of the collapsible tubes. There is also a long felt need in the art for a tube-squeezing device that allows the users to conveniently evacuate all the material out of the tube body. Additionally, there is a long felt need in the art for a tube-squeezing device which prevents unwanted wastage of material or product inside the tube and therefore saves money as well. Moreover, there is a long felt need in the art for a tube squeezing device that can be easily used by children, adults, the elderly and others for evacuating all the product from the tube. Further, there is a long felt need in the art for a product-dispensing solution that does not require the users to expend a great deal of effort in dispensing material out of the collapsible tubes. Furthermore, there is a long felt need in the art for a tube squeezer which eliminates the need to tamper with, or cut open, the collapsible tube body to completely extract the material out of the tube. Finally, there is a long felt need in the art for a tube-squeezing device that ensures all product or material is evacuated from the tube and saves the rest of the product and money.

The present invention, in one exemplary embodiment, comprises a tube-squeezing device. The tube-squeezing device is configured to remove product or material from the tube effectively and without any wastage. The tube-squeezing device further comprises a handle, an upper arm and a lower arm. The upper arm and the lower arm are attached to an interior surface of the handle and extend orthogonal from the handle. A slot is formed between the upper arm and the lower arm along the length of the arms and is configured and dimensioned to receive the tube therebetween for rolling and squeezing of the tube. The arms are telescoping and can be extended or retracted to fit tubes of various widths. The tube-squeezing device is rotated to roll the arms along the tube body in order to squeeze, wind, and coil the tube body, thereby pushing and advancing the material within the tube towards the dispensing end for easy evacuation with minimal to no wastage.

Referring initially to the drawings, FIG. 1 illustrates a perspective view of one potential embodiment of a tube-squeezing device 100 of the present invention in accordance with the disclosed architecture. More specifically, the tube-squeezing device 100 is configured and dimensioned to receive a tube such as a paste tube for evacuating the remainder of a product or material from inside the tube. The tube-squeezing device 100 is an integrated device having a rectangular handle 102 to firmly grasp the device 100 for convenient handling and winding. The handle 102 is ergonomically-designed and fits comfortably in the hand of a user. On the inner surface 1020 of the handle 102, an extendable upper arm 104 is attached thereto having a telescopic longitudinal clip arm 1042 with a stationary cover sleeve 1040. Additionally, the inner surface 1020 of the handle 102 includes an extendable lower arm 106 attached thereto having a telescopic longitudinal clip arm 1062 with a stationary cover sleeve 1060.

The arms 104, 106 are permanently attached to the inner surface 1020 and are parallel to each other. A slot 108 is created between the upper arm 104 and the lower arm 106 using a separator 110. The separator 110 separates the upper arm 104 and the lower arm 106, thereby creating the slot 108 to receive a terminal closed end of a tube in a lateral orientation, such as a paste tube or an ointment tube. In one embodiment, the arms 104, 106 can have internal edges extending into the slot 108 which can be threaded along the surface of a tube inserted laterally in the slot 108 for effective rolling and winding movement of the device 100. The upper arm 104 and the lower arm 106 form the clip end of the device 100.

A tube when inserted into the slot 108 is retained between the clip arms 104, 106. The device 100 can be rolled or wound along the tube to ensure the material or product of the tube is pushed toward a dispensing end for complete evacuation of the material. Alternatively, the device 100 can also be slid along the length of the tube (see e.g., FIG. 2) to push the material toward a dispensing end to evacuate the material or product therefrom. The device 100, in a sliding arrangement, retains the balance and character of the tube and is easy to use.

The tube squeezer 100 can be made up of lightweight and durable material such as plastic, aluminum or wood. The telescoping nature of the clip arms 1042, 1062 allows the device 100 to fit paste tubes, medicine tubes and paint tubes. The device also fits tubes for cosmetics, adhesives, lotions, ointments, make-up and more. The device 100 is convenient and easy to use in order to extrude material or product from the tube mounted thereto. The device 100 avoids waste by completely emptying the tubes.

Figure 2:
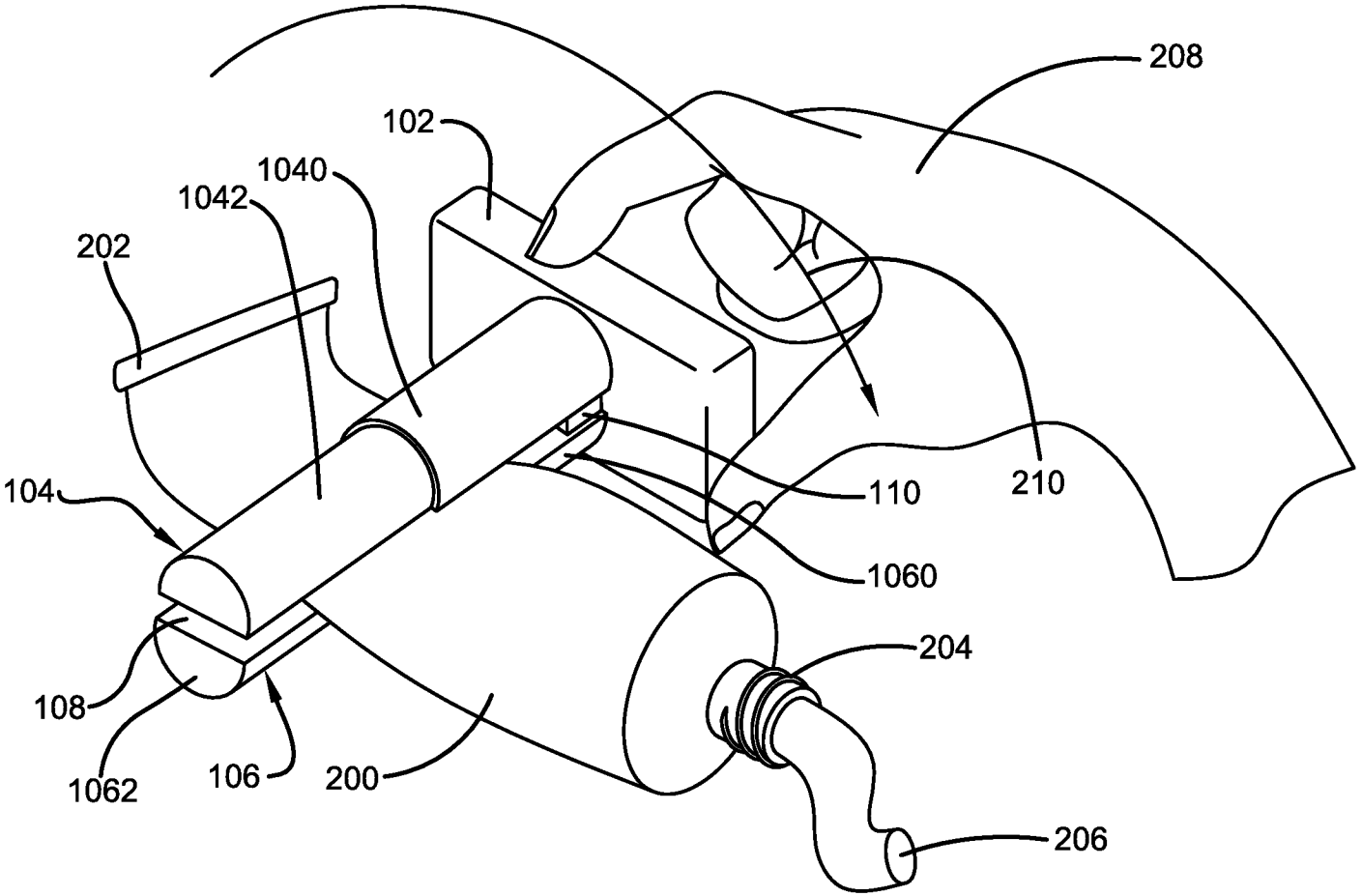
FIG. 2 illustrates a perspective view of one potential embodiment of the tube-squeezing device of the present invention being used to empty the contents of a tube in accordance with the disclosed architecture.

FIG. 2 illustrates a perspective view of one potential embodiment of the tube-squeezing device 100 of the present invention being used to empty the contents of a tube 200 in accordance with the disclosed architecture. More specifically, the tube 200 may be laterally inserted into the slot 108 through the closed end 202 of the tube 200. The size of the slot and length of the arms 104, 106 can be customized to accommodate varying widths of the tube 200. The material or product 206 in the tube 200 is dispensed from the dispensing end 204 of the tube 200 when the device 100 is rolled, wound or 'walked' along the tube 200 using the handle 102 by a user 208. The handle 102 is grasped by a user 208 and is rotated towards the dispensing end 204 in the direction shown by the arrow 210. The device 100 can be easily used by individuals with compromised or limited physical dexterity to remove the product 206 from the tube 200.

By rotating, winding, and/or 'walking' the squeezing device 100 towards the dispensing end 204 of the tube 200, the tube 100 is rolled and squeezed in order to advance and accumulate the remaining product or material 206 of the tube 100 at the dispensing end 204 from where the product can be extruded easily without applying any additional force. The device 100 works well with metal, aluminum, plastic, squeezable and/or flexible tubes. The device 100 can include a wall suction hanging holder that can be hung on a wall or mirror for secure storage of the device 100.

The device 100 can clip on a tube 200 firmly, and because of the narrow profile and adjustable slot 108 between the arms, the device 100 can be used with a brand-new tube where it will remain clipped on firmly. When the squeezer device 100 is used, a combination of rolling, sliding, and rolling again can take place based on differing fingers and hand positioning of a user on the handle 102. Ideally, the use of the device 100 starts proximal to the terminal closed end 202 of the tube 200. The interior surfaces of the arms 104, 106 can come in a smooth finish or a coarse pebbled finish 1072. The additional friction of a coarse or pebble finished rod 1072 can be more effective on certain types of tubes. The arms 104, 106 are longitudinal but can be cylindrical, octagonal, hexagonal or more.

The upper telescopic longitudinal clip arm 1042 can extend from the stationary cover sleeve 1040. Similarly, the lower telescopic longitudinal clip arm 1062 can extend from the stationary cover sleeve 1060. The telescoping extension allows a tube of larger width to be accommodated into the slot of the device. Similarly, to accommodate a tube of smaller width, the upper telescopic longitudinal clip arm 1042 can retract into the stationary cover sleeve 1040, and the lower telescopic longitudinal clip arm 1062 can retract into the stationary cover sleeve 1060.

Figure 3:
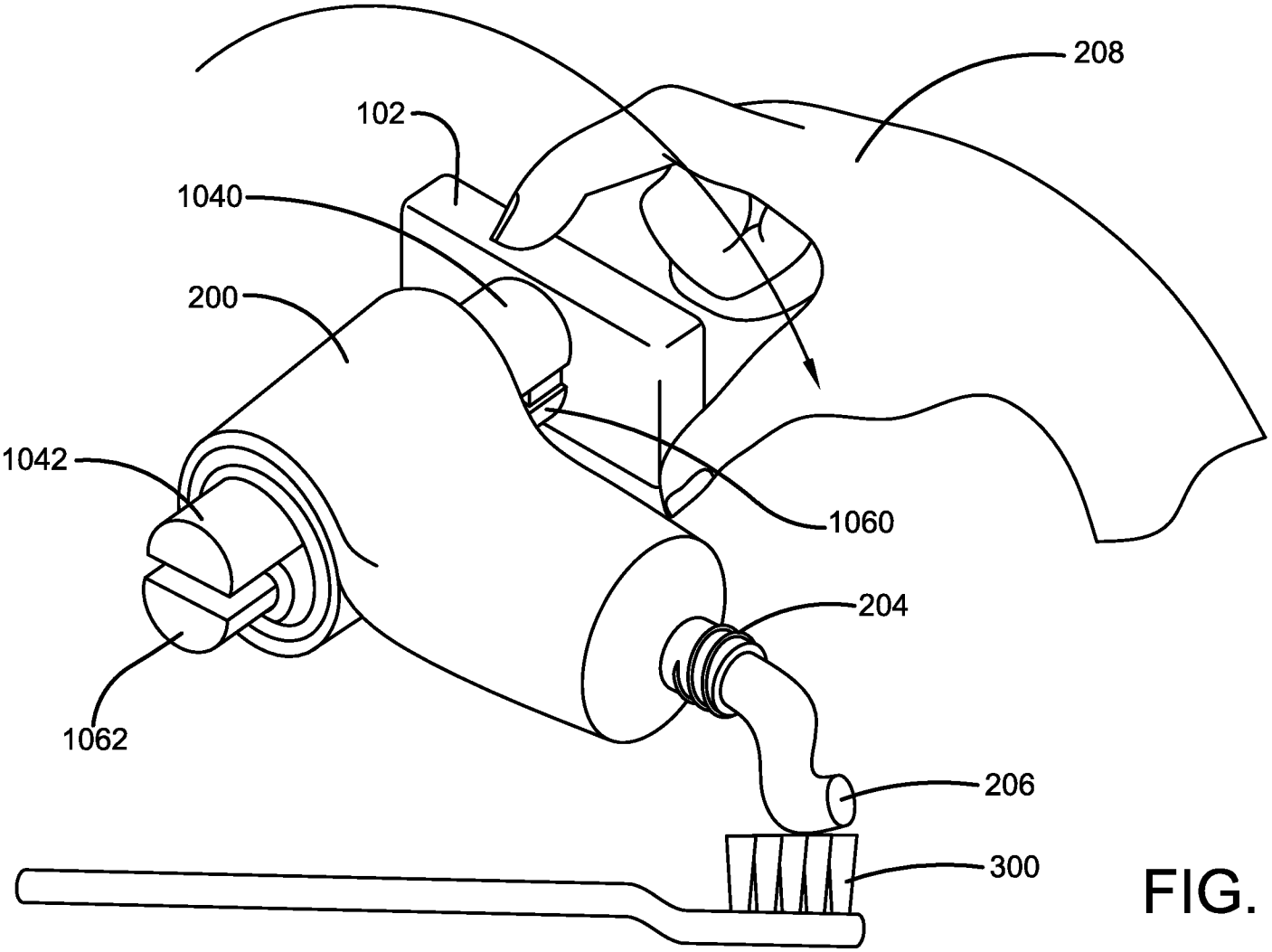
FIG. 3 illustrates a perspective view of one potential embodiment of the tube-squeezing device of the present invention being used to apply toothpaste from a tube to a toothbrush in accordance with the disclosed architecture.

FIG. 3 illustrates a perspective view of one potential embodiment of the tube-squeezing device 100 of the present invention being used to apply toothpaste from a tube to a toothbrush in accordance with the disclosed architecture. More specifically, as the tube-squeezing device 100 is rotated using the handle 102, the arms 104, 106 roll along the length of the tube 200, and the tube length on which the arms 104, 106 are rolled is wound around the upper arm components 1040, 1042 and the lower arm components 1060, 1062. Additionally, as the device 100 is rolled, the material or product 206 within the tube is accumulated and squeezed toward the dispensing end 204 of the tube 200 for extrusion therefrom. The rolling or winding of the tube 200 around the arms 104, 106 does not impede the motion of the device 100 on the tube 200 and provides an effective evacuation of the product 206 without any wastage.

In this manner, and as best shown in FIG. 3, the user 208 may use the tube-squeezing device 100 of the present invention to evacuate the product or material 206 out of the tube 200 such as, for example, toothpaste from a tube and over a toothbrush 300. The tube 200 rolls or winds around the device 100 to effectively urge evacuation of the remaining product, and prevent unwanted wastage of product.

Figure 4:
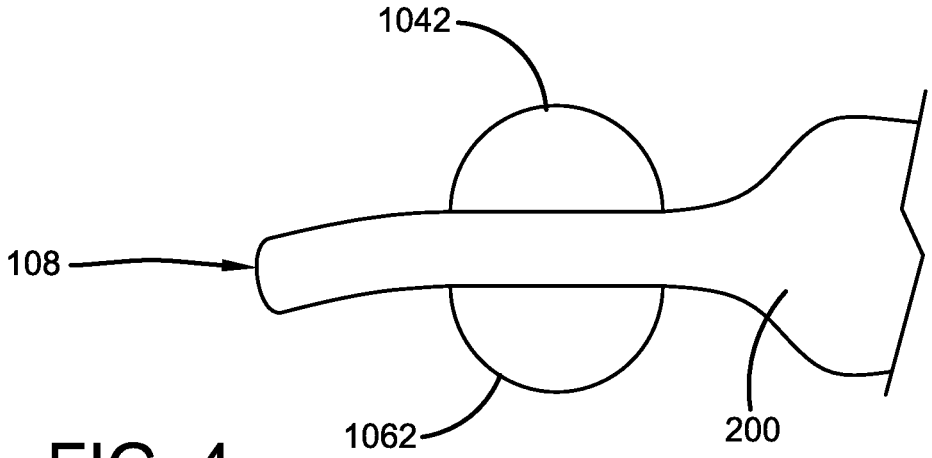
FIG. 4 illustrates a front plan view of one potential embodiment of the tube-squeezing device of the present invention with a tube inserted in the slot of the device in accordance with the disclosed architecture.

FIG. 4 illustrates a front plan view of one potential embodiment of the tube-squeezing device 100 of the present invention with a tube inserted in the slot of the device in accordance with the disclosed architecture. More specifically, the upper telescoping arm 1042 and the lower telescoping arm 1062 accommodate and balance the tube 200 accommodated in the slot 108 present between the telescoping arms 1042, 1062. The width of the slot 108 can be increased or decreased as per the preferences of a user and tube size.

Figure 5:
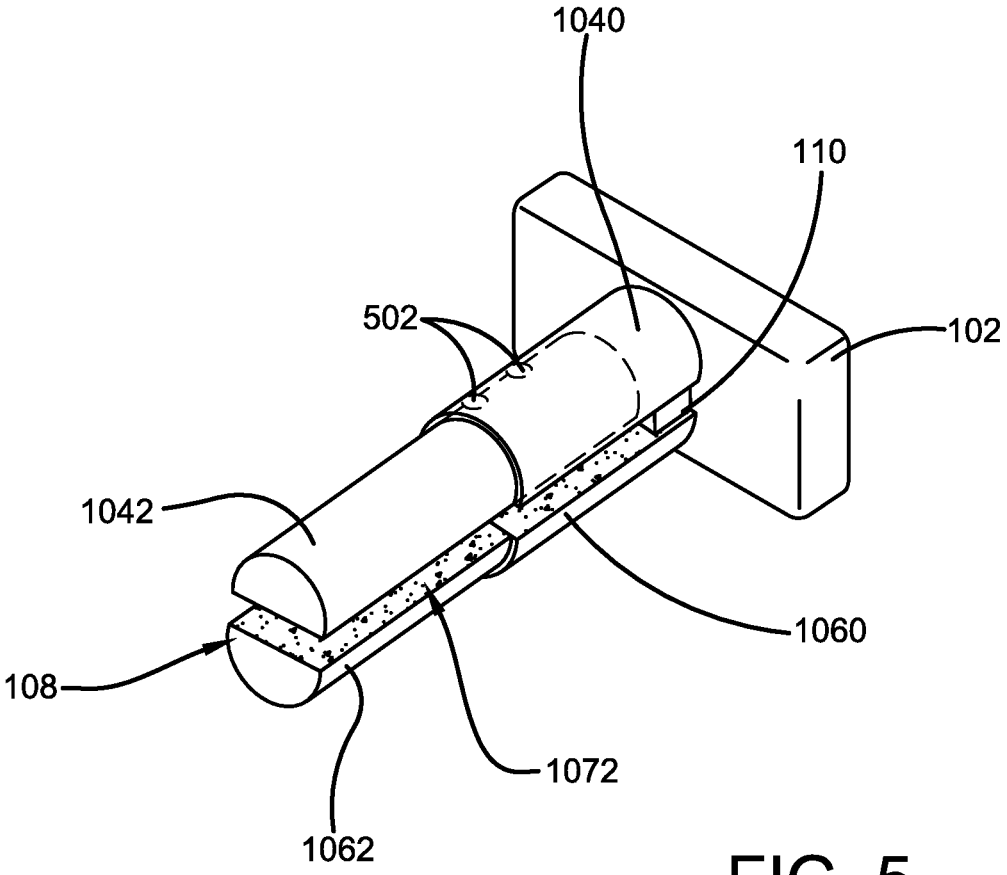
FIG. 5 illustrates a perspective view of one potential embodiment of the tube-squeezing device of the present invention in accordance with the disclosed architecture, wherein the tube squeezing device comprises a telescoping mechanism.

FIG. 5 illustrates a perspective view of one potential embodiment of the tube-squeezing device 100 of the present invention in accordance with the disclosed architecture, wherein the tube squeezing device 100 comprises a telescoping mechanism. To accommodate a tube 200 of a larger width, the upper telescoping clip arm 1042 can be extended from the stationary cover sleeve 1040 by pulling the telescoping clip arm 1042 with a minimal force. Similarly, the lower telescoping clip arm 1062 can be extended from the stationary cover sleeve 1060 by pulling the telescoping clip arm 1062 with a minimal force. The cover sleeves 1040, 1060 include telescoping recesses along which the telescoping clip arms 1042, 1062 slide respectively. The telescoping sections can be provided with an internal groove construction 502 in the stationary cover sleeve 1040 to keep the upper clip arm 1042 from turning with respect to the cover sleeve 1040. In addition, there can be releasable detents to keep the upper clip arm 1042 in an extended position. To retract the upper clip arm 1042 from the fully-extended position, a minimal force can be applied to push the clip arm 1042 into the cover sleeve 1040.

It should be appreciated that the telescoping means for the lower arm 106, i.e. lower telescoping clip arm 1062 and the lower cover sleeve 1060, can be the same as described above for the upper arm 104. The upper telescoping clip arm 1042 and the lower telescoping clip arm 1062 are held together and are extended outwards to accommodate collapsible tubes of larger width. Additionally, the arms 1042 and 1062 are retracted by pushing the extended arms 1042, 1062 into the cover sleeves 1040, 1060 to accommodate collapsible tubes of smaller widths. Alternatively, there can be a push button to extend and retract the arms.

In one potential embodiment of the present invention, the slot size (i.e. height of the slot) can be increased to accommodate thicker tubes and thicker materials used for same. The clip arms 1042, 1062 are adjustable whereby the arms can be slightly elongated to increase the slot 108 length. A spring can be present near the separator or connector 110 that enables slight vertical movement or displacement of the clip arms. Tubes including thicknesses in the range of 0.2-1.0 inches can be used with the device 100. Also, tubes having widths in the range of 1.0-3.0 inches can be used with the device 100.

The tube-squeezing device 100 of the present invention provides a new lightweight and effective tube squeezer, which is compatible with low cost manufacturing with regard to both materials and labor, and which accordingly is then compatible with low prices of sale to the consuming public, thereby making the squeezing device 100 economically available to the buying public.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "tube-squeezing device", "squeezing device", "squeezer", "device" and "tube squeezer" are interchangeable and refer to the tube-squeezing device 100 of the present invention.

Notwithstanding the forgoing, the tube-squeezing device 100 of the present invention can be of any suitable size and configuration as is known in the art without affecting the overall concept of the invention, provided that it accomplishes the above-stated objectives. One of ordinary skill in the art will appreciate that the size, configuration, and material of the tube-squeezing device 100 as shown in the FIGS. are for illustrative purposes only, and that many other sizes and shapes of the tube-squeezing device 100 are well within the scope of the present disclosure. Although the dimensions of the tube-squeezing device 100 are important design parameters for user convenience, the tube-squeezing device 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A tube squeezing device for evacuating a product from a flexible tube, the tube device comprising:

a handle;

an upper arm;

a lower arm;

said upper arm and said lower arm extending longitudinally and orthogonally from an interior surface of said handle;

a slot formed between said upper arm and said lower arm along a length of said upper arm and said lower arm;

said upper arm and said lower arm extendable and retractable in a longitudinal direction to receive a select one of a plurality of flexible tubes having varying widths;

said upper arm and said lower arm laterally receive a portion of said select one of a plurality of flexible tubes in said slot;

wherein turning said handle winds the select one of a plurality of flexible tubes around said upper arm and said lower arm; and wherein said winding of the select one of a plurality of flexible tubes forces a material stored therein towards a dispensing end of the select one of a plurality of flexible tubes.

2. The tube squeezing device of claim 1, wherein said upper arm comprises an upper arm first stationary sleeve section and an upper arm second telescopic clip arm section, and further wherein said upper arm second telescopic clip arm section extends outwardly from said upper arm first stationary sleeve section.

3. The tube squeezing device of claim 2, wherein said lower arm comprises a lower arm first stationary sleeve section and a lower arm second telescopic clip arm section, and further wherein said lower arm second telescopic clip arm section extends outwardly from said lower arm first stationary sleeve section.

4. The tube squeezing device of claim 3 further comprising a separator mounted between said upper arm and said lower arm to maintain a separation between said upper arm and said lower arm.

5. The tube squeezing device of claim 4, wherein each of the handle, the upper arm and the lower arm comprise a material selected from a group consisting of a plastic material, an aluminum material and a wood material.

6. The tube squeezing device of claim 5 further comprising a wall suction hanging holder.

7. The tube squeezing device of claim 6, wherein each of said upper arm and said lower arm comprises an interior surface, and further wherein said interior surface comprises a coarse pebbled finish.

8. A method of squeezing a material from a flexible tube, the method comprising the steps of:

providing a tube squeezing device comprised of a handle, an upper arm, and a lower arm;

extending said upper arm and said lower arm longitudinally and orthogonally from an interior surface of said handle to accommodate a selectable width of said flexible tube;

forming a slot between said upper arm and said lower arm along the length of said upper arm and said lower arm;

receiving laterally a portion of said flexible tube between said slot to anchor a terminal end of said flexible tube; and turning said handle to wind said flexible tube around said upper arm and said lower arm, wherein said winding of said flexible tube pushes the material inside said flexible tube towards a dispensing end of said flexible tube for extrusion therefrom;

wherein each of said upper arm and said lower arm are extendable and retractable in a longitudinal direction to accommodate varying widths of said flexible tube.

9. The method of claim 8, wherein said upper arm comprises an upper arm first stationary sleeve section and an upper arm second telescopic clip arm section, and further wherein said upper arm second telescopic clip arm section extends outwardly from said upper arm first stationary sleeve section.

10. The method of claim 9, wherein said lower arm comprises a lower arm first stationary sleeve section and a lower arm second telescopic clip arm section, and further wherein said lower arm second telescopic clip arm section extends outwardly from said lower arm first stationary sleeve section.

11. The method of claim 10 further comprising a step of mounting a separator between said upper arm and said lower arm to maintain a separation between said upper arm and said lower arm.

12. The method of claim 11, wherein each of said handle, said upper arm, and said lower arm comprise a material selected from a group consisting of a plastic material, an aluminum material, and a wood material.

13. The method of claim 12, wherein each of said upper arm and said lower arm comprises an interior surface having a coarse pebbled finish.

14. A method of squeezing a material from a flexible tube, the method comprising the steps of:

providing a tube squeezing device comprise of a handle, an upper arm, and a lower arm;

extending said upper arm and said lower arm longitudinally and orthogonally from an interior surface of said handle to accommodate a selectable width of said flexible tube;

forming a slot between said upper arm and said lower arm along a length of said upper arm and said lower arm;

receiving laterally a portion of said flexible tube between said slot;

rolling said handle a first rotation and squeezing said flexible tube between said upper arm and said lower arm;

sliding said handle toward a dispensing end of said flexible tube; and rolling said handle at least a second rotation and squeezing said flexible tube between said upper arm and said lower arm, wherein said rolling of said flexible tube squeezes said flexible tube and pushes the material inside said flexible tube towards said dispensing end of said flexible tube for extrusion therefrom;

wherein each of said upper arm and said lower arm are extendable and retractable in a longitudinal direction to accommodate varying widths of said flexible tube.

15. The method of claim 14, wherein said upper arm comprises an upper arm first stationary sleeve section and an upper arm second telescopic clip arm section, and further wherein said upper arm second telescopic clip arm section is outwardly extendable from said upper arm first stationary sleeve section.

16. The method of claim 15, wherein said lower arm comprises a lower arm first stationary sleeve section and a lower arm second telescopic clip arm section, and further wherein said lower arm second telescopic clip arm section is outwardly extendable from said lower arm first stationary sleeve section.

17. The method of claim 16 further comprising a step of mounting a separator between said upper arm and said lower arm to maintain a separation between said upper arm and said lower arm.

18. The method of claim 17, wherein each of said upper arm and said lower arm comprises an interior surface having a coarse pebbled finish.

* * * * *